US008052370B2

(12) United States Patent
Dekker et al.

(10) Patent No.: US 8,052,370 B2
(45) Date of Patent: Nov. 8, 2011

(54) SYSTEM FOR HANDLING PIPES BETWEEN A PIPE RACK AND A DERRICK, AND ALSO A DEVICE FOR ASSEMBLING AND DISASSEMBLING PIPE STANDS

(75) Inventors: Cees Jan Dekker, Zaanclam (NL); John H. W. M. Stouten, Franeker (NL); Erik Zachariasen, Kristiansand (NO); Finn Engenes, Søgne (NO)

(73) Assignee: Sense EDM AS, Kristiansand (NO)

( * ) Notice: Subject to any disclaimer, the term of this patent is extended or adjusted under 35 U.S.C. 154(b) by 727 days.

(21) Appl. No.: 11/793,355

(22) PCT Filed: Dec. 1, 2005

(86) PCT No.: PCT/NO2005/000444
§ 371 (c)(1),
(2), (4) Date: Jul. 11, 2008

(87) PCT Pub. No.: WO2006/059910
PCT Pub. Date: Jun. 8, 2006

(65) Prior Publication Data

US 2008/0304939 A1 Dec. 11, 2008

(30) Foreign Application Priority Data

Dec. 1, 2004 (NO) ..... 20045263

(51) Int. Cl.
*E21B 19/00* (2006.01)

(52) U.S. Cl. ..... 414/22.66

(58) Field of Classification Search ..... 166/360, 166/77.51–77.52; 175/58, 85; 211/70.4; 414/22.51–22.59, 22.62, 2.66, 22.68, 22.71
See application file for complete search history.

(56) References Cited

U.S. PATENT DOCUMENTS

| | | | | | |
|---|---|---|---|---|---|
| 2,321,245 | A | * | 6/1943 | Reed | 166/77.51 |
| 3,212,593 | A | * | 10/1965 | Reischl | 175/85 |
| 3,966,054 | A | * | 6/1976 | Kelly | 211/70.4 |
| 4,081,087 | A | | 3/1978 | Freeman, Sr. | |
| 4,692,081 | A | * | 9/1987 | Bennett et al. | 414/22.61 |
| 4,708,563 | A | * | 11/1987 | Van Den Berg et al. | 414/22.66 |
| 4,762,185 | A | * | 8/1988 | Simpson | 175/5 |
| 4,843,945 | A | * | 7/1989 | Dinsdale | 81/57.34 |
| 5,468,121 | A | | 11/1995 | Stogner | |
| 5,931,238 | A | | 8/1999 | Gilmore et al. | |
| 6,513,605 | B1 | | 2/2003 | Lödden | |

FOREIGN PATENT DOCUMENTS

| | | | |
|---|---|---|---|
| GB | 2264734 | A * | 9/1993 |
| WO | WO-02/057593 | A1 | 7/2002 |

* cited by examiner

*Primary Examiner* — Gregory Adams
(74) *Attorney, Agent, or Firm* — Birch, Stewart, Kolasch & Birch, LLP

(57) ABSTRACT

A system for handling pipes between a pipe rack (16) and a derrick (1), which derrick (1) is located on a drilling deck (2), in connection with the production of petroleum products. The system comprises means (17, 9, 25) of carrying pipe lengths (29) between the rack (16) and the derrick (1). It also comprises a unit (25) at the drilling deck (2) for temporary storage of at least two pipe lengths (29) in respective receiving chambers (26, 28). The receiving chambers (26, 28) can be moved to and from at least one receiving and/or hand-over position, in which position a pipe handling unit is arranged to hand over a pipe length to a receiving chamber (26-28) and/or retrieve a pipe length from a receiving chamber (26-28). Preferably the unit (25) is rotatable and located under an opening (28) in the drilling deck (2).

12 Claims, 4 Drawing Sheets

SECTION A–A

SECTION A–A

SYSTEM FOR HANDLING PIPES BETWEEN A PIPE RACK AND A DERRICK, AND ALSO A DEVICE FOR ASSEMBLING AND DISASSEMBLING PIPE STANDS

The present invention regards a system for handling pipes between a pipe rack and a derrick in connection with the production of petroleum products, in accordance with the preamble of Claim 1.

The invention also regards a device for assembling and disassembling pipe stands (stands are lengths of piping made up of two or more single pipes) in accordance with the preamble of Claim 4.

Hereinafter, the term pipe length will refer both to single pipes and stands.

When producing petroleum products, use is made of a drilling derrick, which forms part of a rig. The rig may be situated either onshore or offshore. Offshore, the rig may be a fixed structure standing on the seabed, or it may be a floating structure which is either tethered to the seabed or dynamically positioned.

The main function of the drilling derrick is to provide suspension for winching equipment that is used to lower a drill string, riser, casing and other continuous pipe strings down to or into a well, as well as lifting the drill string out of the well.

A time-critical factor of drilling operations and other operations that involve lowering and retrieval of a long pipe string ("tripping" in technical terminology) is the transport to and from the drilling derrick. It has therefore been desirable to store stands (consisting of 2, 3 or 4 drill pipes) as close to the derrick as possible. However, space is highly restricted in this area, as other essential equipment must also be stored here. Another argument for moving the stands away from the actual drilling deck is that placing them at a lower level would lower the centre of gravity. Thus these storage racks near the drilling derrick can hold only a limited number of pipes.

Much effort has gone into developing equipment that will provide rapid transport of stands to the drilling derrick, in some cases directly to the drilling centre (the line followed by the pipe string through the derrick). It is equally important to be able to quickly remove pipes that have been detached from the pipe string.

Great emphasis has also been placed on the safety aspects involved in the development of this type of pipe handling equipment. Consequently more and more automated equipment has been developed, requiring a minimum number of personnel on the drilling deck.

One element that has been developed to make the pipe handling more efficient is the use of a so-called mousehole. This is a hole in the drilling deck arranged to receive pipes for intermediate storage. This makes it possible to bring in a stand which is then ready for subsequent transport to the drilling centre as soon as the need arises.

Assembling a stand is done by first placing one pipe in the mousehole and then screwing another pipe down onto the top of the first pipe. This may be followed by a more pipes being screwed onto the bottom of the first two, which then have to be lifted up before this coupling operation. It is also possible to temporarily store stands that are removed from the drilling centre pending onwards transport to the pipe rack, or stands can be dismantled in the mousehole and the pipes then transported separately to the pipe rack. It is also possible to assemble/disassemble stands at the drilling centre but this will slow the tripping down considerably.

Despite the above efforts that have been put into development work, the pipe handling to and from the derrick is still a bottle neck.

The present invention aims to provide a system that will further reduce the time wasted in handling pipes and stands to and from the derrick. This is achieved by the characteristics stated in the characterizing part of the following Claim 1.

According to a preferred embodiment of the system it comprises a catwalk (pipe bridge) and a V-door lifter, the V-door lifter being arranged to carry pipes between the catwalk and the unit. This allows conventional conveying equipment to be used without requiring significant modifications.

In a further preferred embodiment the unit for storage of pipe lengths is arranged below the drilling deck, and the receiving and/or hand-over position coincides with an opening in the drilling deck. Thus the unit can in principle be used as a conventional mousehole.

The invention also provides a device for assembling and disassembling stands in accordance with the characterising part of the following Claim 4.

Preferably the device comprises an elevator arranged to co-operate with the receiving chambers in order to move a pipe length longitudinally in the receiving chambers. Thus pipe lengths may be lowered to a level below the drilling deck and also be set up so as to be ready for onward transport by conventional pipe handling devices.

Preferably the elevator is arranged in connection with the receiving and/or hand-over position, and the receiving chambers can be moved into engagement with the elevator. As a result, one elevator may serve several receiving chambers.

Alternatively, each receiving chamber is associated with a respective elevator and the elevator can be moved along with the associated receiving chamber. This avoids having to set the receiving chamber exactly in relation to the elevator every time the receiving chamber is to be moved to the receiving or hand-over position.

The elevator comprises a hydraulic cylinder or alternatively a system comprising a chain, sprocket wheels and a motor, and a movable shoulder. These solutions provide reliable and simple devices for longitudinal displacement of the pipes into the receiving chambers.

Preferably each receiving chamber is equipped with a shock absorber made from a soft material, on which a pipe in the receiving chamber is intended to land. This avoids damage to the pipe ends when a pipe is lowered into a receiving chamber.

Preferably the receiving chambers are arranged on a rotatable unit that provides a compact, simple and reliable unit.

Preferably the receiving chambers are arranged to co-operate with conveying devices for stands, and conveying devices for single pipes, for transport into and out of the receiving chambers. This makes it possible to use the unit both for assembly of stands and temporary storage of stands to be brought into or out of the drilling centre.

The invention will now be explained in greater detail with reference to the accompanying drawings, in which:

FIGS. 1*a-c* show a front elevation of a pipe handling system according to the present invention, in a sequence;

Figure 1A:
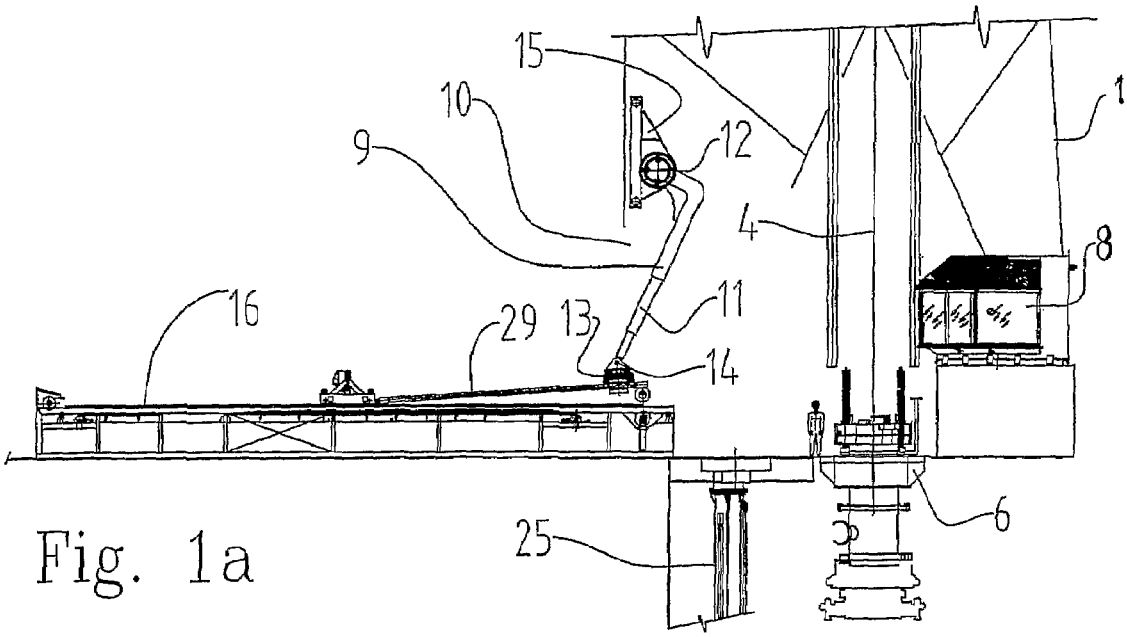
Figure 1B:
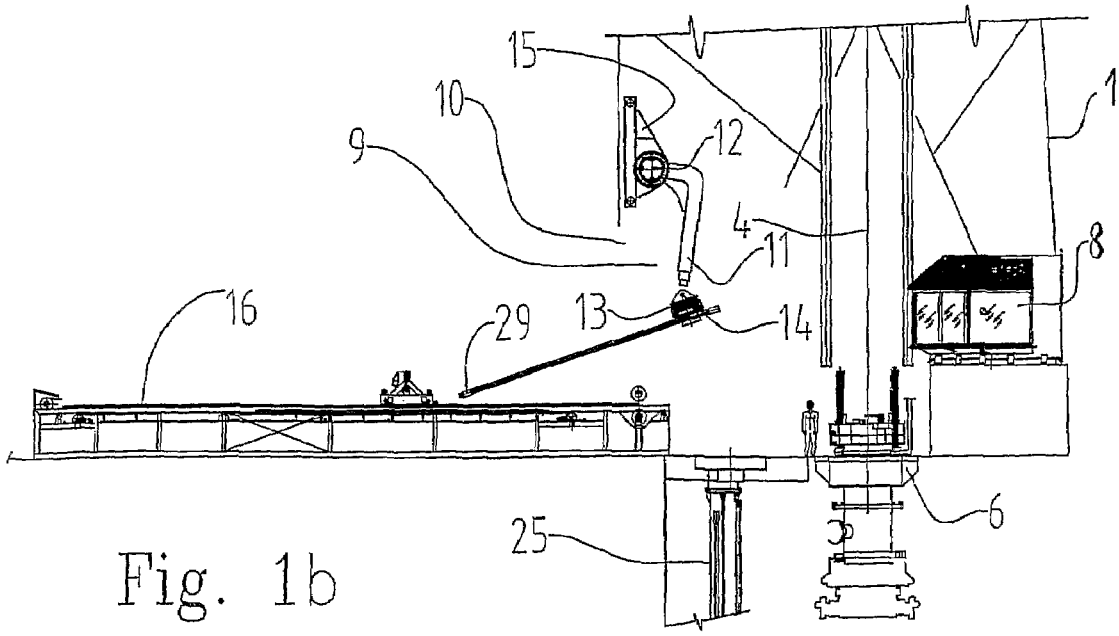
Figure 1C:
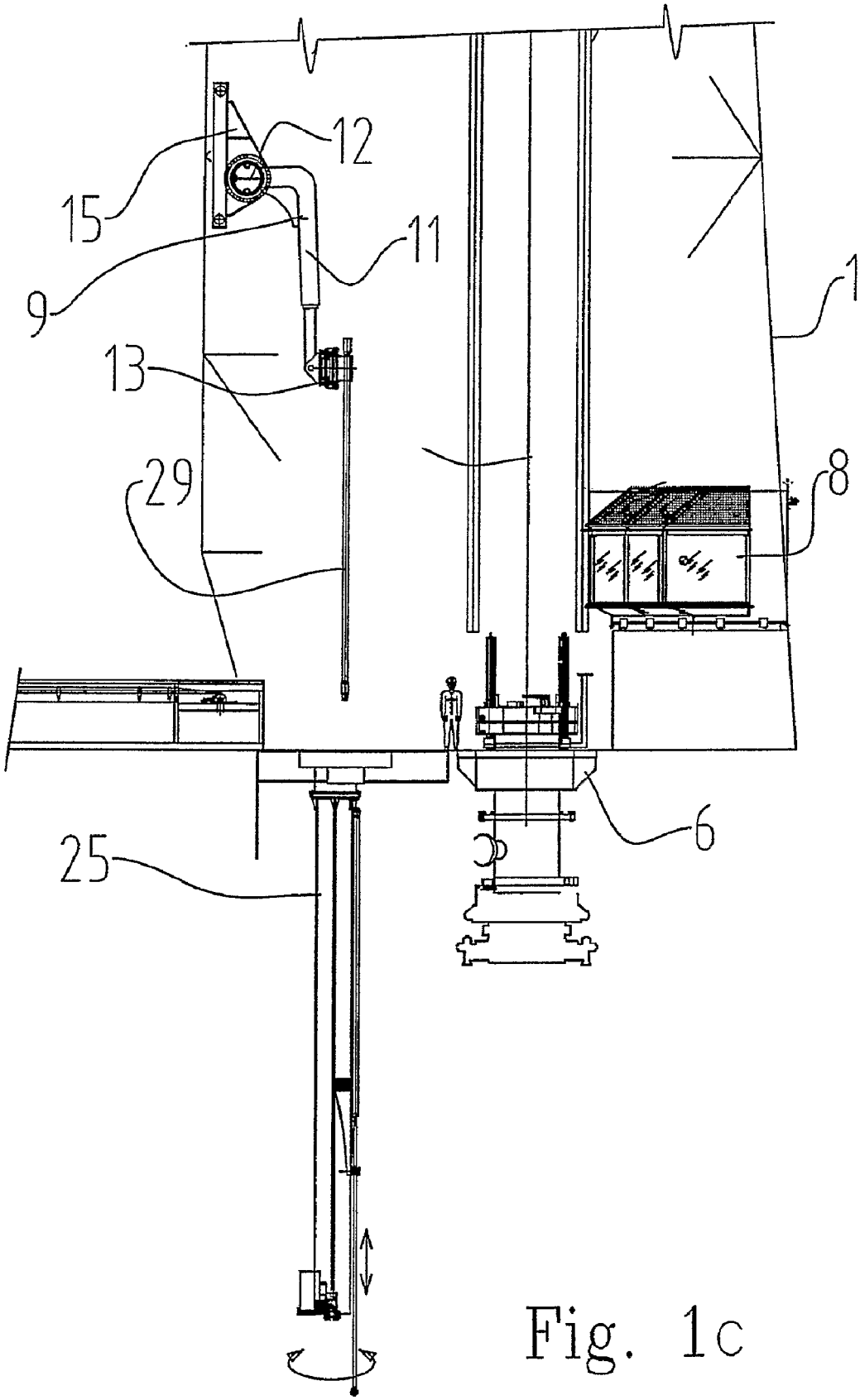

FIGS. 1*a-c* illustrate part of a drilling derrick 1. The drilling derrick rests on a drilling deck 2. Suspended in the drilling derrick 1 is a block (not shown), which forms part of a drawworks. The block is arranged to move vertically along a drilling axis 4 running through the derrick 1. From the block 3 there is suspended a top drive (not shown). From the top drive there may be suspended a drill string extending along the drilling axis 4, through the rotary 6 and on down to the seabed.

FIG. 1 also shows a control room 8, from which the drilling operation and pipe handling are controlled.

On the drilling deck there is a V-door lifter 9. The V-door lifter is suspended over the so-called V-door 10 into the drilling derrick 1. The V-door lifter 9 comprises an arm 11, the inner end of which is rotatably connected to a trolley 15 about a horizontal axis 12. The trolley 15 can move vertically in the derrick 1. The arm 11 is telescopic. At the outer end of the arm 11 there is provided a gripper 13. The gripper 13 can swivel about a horizontal axis 14 at the outer end of the arm 11. Thus the V-door lifter 9 arm 11 is capable of gripping a pipe 29 in order to lift into vertical position and move it to a position within the derrick and vice versa.

A catwalk 16 is provided by the V-door to convey pipes 29 from a pipe rack (not shown). This conveys the pipe 29 longitudinally and substantially horizontal to a position in which it can be gripped by the V-door lifter 9.

The V-door lifter 9 and the catwalk 16 are well known to a person skilled in the art and are suitable for handling of single pipes.

For handling pipe stands it is possible to use a rotatable column with a lower extendable support arm and an upper extendable lift arm, the outer ends of which are equipped with a gripper and a support, respectively, arranged to grip and support stands. With this, the conveying device is capable of gripping a pipe stand in order to move it between the drilling axis and various positions on or by the drilling deck.

In the drilling deck 2 there is provided an assembly and disassembly unit 25 for pipe stands. The unit 25 can also serve as an intermediate storage unit for two or more pipes, or a pipe stand. The unit 25 acts as a multi-hole mousehole unit, with the capacity to store pipes in a lowered position in the drilling deck.

The unit 25 will now be explained in greater detail with reference to FIGS. 2-4.

Figure 2:
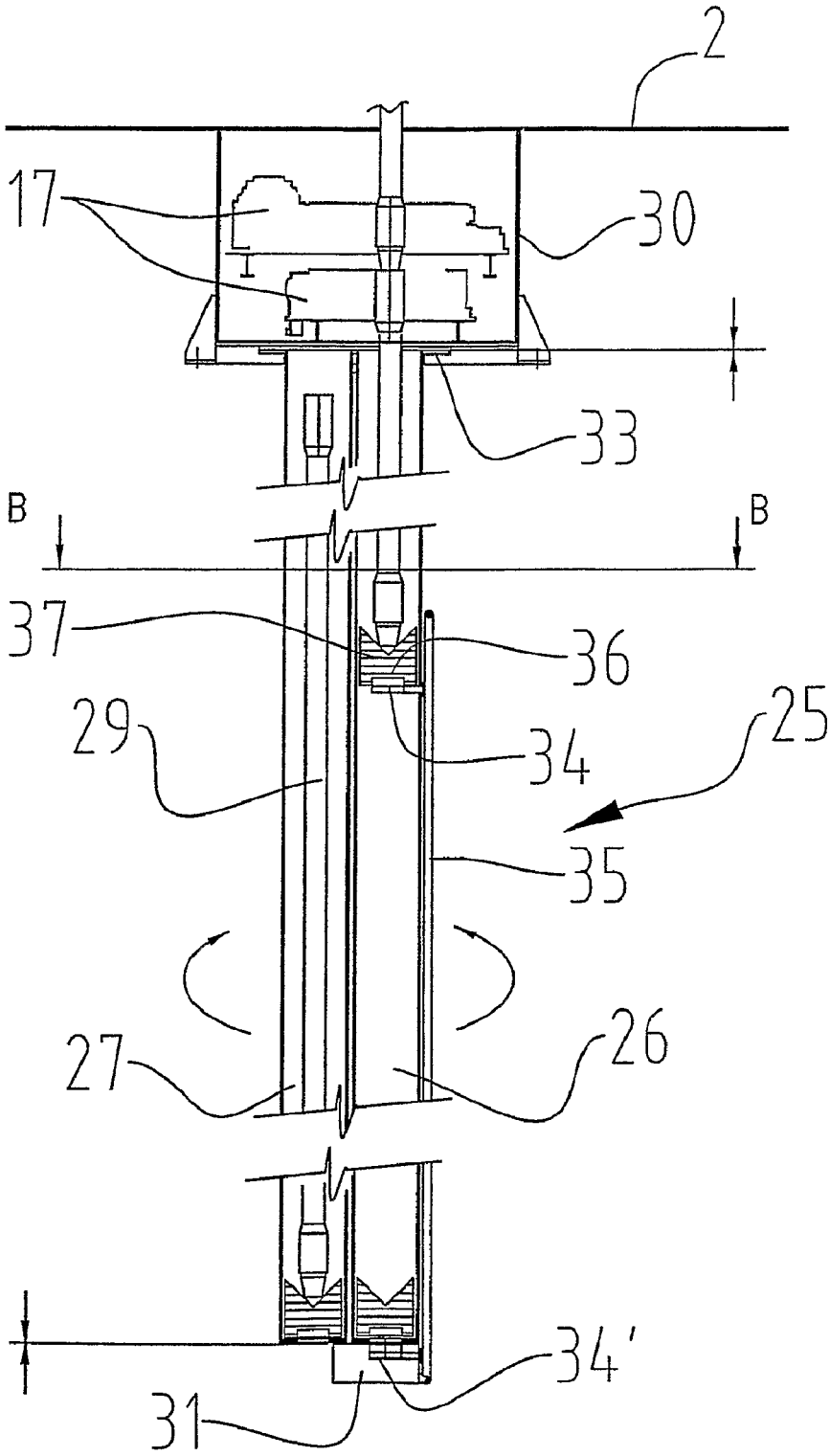
FIG. 2 shows a longitudinal section through an assembly and disassembly unit according to the present invention.

FIG. 2 shows a longitudinal section of the unit 25. The longitudinal section is taken along A-A in FIGS. 3 and 4.

FIG. 2 shows two out of three receiving cylinders 26 and 27 that act as receiving chambers for pipes. The third receiving cylinder 28 is shown in FIG. 3. Preferably the receiving cylinders 26-28 are circular cylindrical, with a larger diameter than the maximum diameter of a drill pipe 29, casing, drill collar etc. The cylinders 26-28 are arranged to be rotatable as a unit in a foundation assembly 30. The foundation assembly 30 is secured to the underside of the drilling deck 2. The foundation assembly 30 is provided with a turret 33 to which the cylinders 26-28 are attached. A hydraulic motor and rim gear drive (not shown) are provided for rotation of the cylinders 26-28. The cylinders 26-28 must be long enough to accommodate one drill pipe, casing, drill collar etc. completely under the drilling deck 2. Often, there will not be enough space below the drilling deck to accommodate lengths that are significantly longer than single pipes.

The assembly/disassembly unit for stands is equipped with an "elevator" 34 and is driven by a driving apparatus 35 comprising a hydraulic motor and an endless chain extending between two sprocket wheels or gear wheels. The "elevator" 34 has an upper landing area 36, which in its lowermost position is located underneath the base of the cylinder 26-28. The landing area 36 is lifted in a shock absorber 37, which in its lowermost position stops at the bottom of the cylinder 26-28. The shock absorber 37 is made from a soft material and arranged so as to prevent the pipes 29 from becoming damaged during placement in the cylinders 26-28. Optionally the shock absorber 37 may have a centering shape (a cone), which ensures that the pipes 29 are placed centrally in the cylinders 26-28. The "elevator" 34 and the associated driving apparatus 35 are rigidly mounted with respect to the foundation assembly 30 on a bracket 31, ensuring that it will be in a position to lift the shock absorber 37 in the cylinder 26-28 which at any one time is positioned in parallel with the elevator 34. Alternatively there may be one "elevator" 34 for each cylinder 26-28, rotatably coupled to the cylinders 26-28. In this case interlocking devices must be provided to prevent the elevator from moving unless the associated cylinder is in the correct position relative to an opening 38 (see FIG. 3) in the drilling deck 2.

Instead of using a chain and sprockets to lift the elevator, such as shown in FIG. 2, use may be made of a hydraulic cylinder.

In FIG. 2 the "elevator" 34 is shown in two positions; a lifted position denoted by 34 and a lowermost position denoted by 34'.

Figure 3:
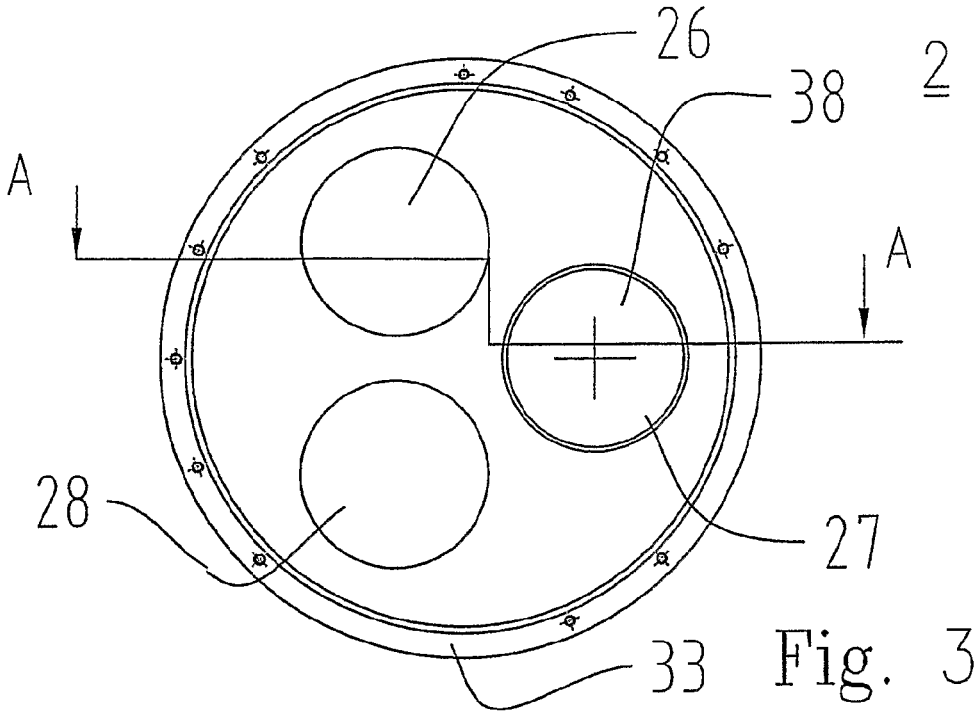
FIG. 3 shows a top view of the assembly and disassembly unit according to FIG. 2.

FIG. 3 is a top view seen in the direction of the drilling deck 2. Here, an opening 38 can be seen in the drilling deck 2. Here, the opening leads into the cylinder 27. The cylinders 26 and 28 plus the turret 33 are indicated in broken lines.

Figure 4:
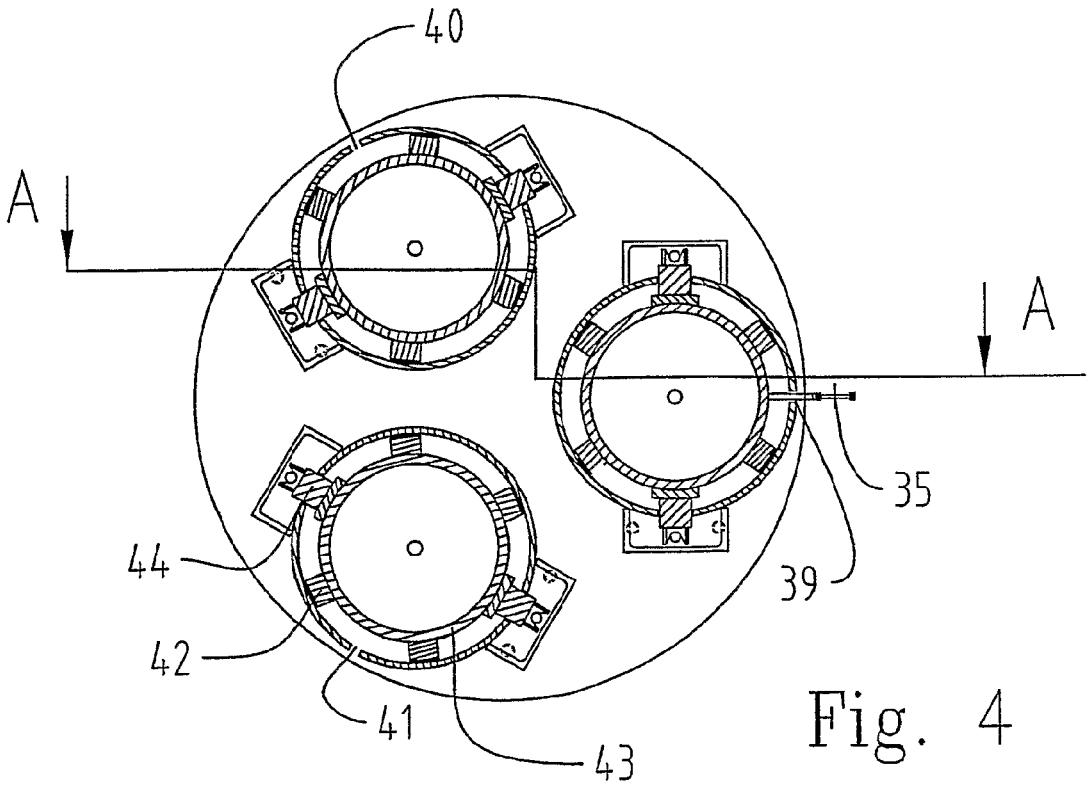
FIG. 4 shows a cross section through the assembly and disassembly unit according to FIG. 2.

FIG. 4 shows a section along line B-B in FIG. 2. Here, each of the cylinders 26-28 can be seen. Also shown is a section through the elevator 34 driving apparatus 35. In the wall of each cylinder 26-28 there is a slot 39, 40, 41 that allows the elevator 34 to move up in the cylinder. In each cylinder there are slideways 42, arranged so as to support the pipes sideways and to ensure that the elevator 34 lifts the pipes in a straight line. Two of the guideways 44 laterally adjustable, so as to accommodate different pipe sizes. FIG. 4 shows pipes of a relatively large diameter.

Over the unit 25 on the drilling deck, or, as shown, included in the foundation assembly, there is provided a pipe tong or a so-called roughneck 17, which is designed to screw pipes together and unscrew them.

The operation of the pipe handling system will now be explained in greater detail.

Pipe 29 is fed out onto the catwalk 16 by a tool (not shown). When the pipe 29 reaches the end of the catwalk 16 it is gripped by the V-door lifter 9, as shown in FIG. 1*a*. The V-door lifter 9 lifts the pipe from the catwalk 16, swinging it into the derrick 1 through the V-door 10. The pipe 29 is turned up to the vertical position, as shown in FIG. 1*c*. The pipe 29 is now directly above the opening 38 in the drilling deck 2. The pipe 29 is then guided into the cylinder 27, which is located under the opening 28. When the pipe 29 has been lowered all the way into the cylinder 27 (possibly by use of the elevator 34), the unit 25 is rotated so as to position e.g. cylinder 26 under the opening 38. This is now ready to receive a second pipe from the V-door lifter 9. Then the unit 25 is rotated so as to position the last cylinder 28 under the opening 38, and a third pipe 29 is guided into this.

The next drill pipe to be received by the V-door lifter 9 is the screwed onto the top of the third pipe located in the cylinder 28 under the hole 38. This screwing operation is carried out by use of the roughneck 17. Then the joined pipes are lifted by the V-door lifter 9 to allow the unit 25 to rotate, bringing another pipe into position under the hole 38. This cycle is repeated for the last pipe located in the cylinder 27, and the joined pipes are then screwed onto the top of the pipe located in the cylinder 27. A pipe stand consisting of four drill pipes has now been assembled.

If shorter pipe stands are required, only two of the cylinders 26-28 need be used. The unit 25 may either be rotated through complete rotations or through a sector of 120°.

The unit 25 may be equipped with two, three or more cylinders. The more cylinders, the longer the pipe stands can be. In order to assemble pipe stands there must be a transport/lifting system that is capable of transporting drill pipes to/from the catwalk 16 and the position 38 of the unit 25, in addition to lifting these out of and into the opening 38. It must also be possible to transport pipe stands to/from a seat-back area (pipe rack) and the centre of the drilling deck. For this purpose one may use other types of equipment than those described above.

An alternative embodiment, which may be of particular relevance if the unit 25 holds a large number of cylinders, entails having two openings in the drilling deck, where one is defined as the hand-over position and the other as the collecting position.

In the case of more cylinders, these may be arranged so as to be movable along an endless path, which may be obtained by mounting the cylinders on a chain. The cylinders may also be arranged in a line that can move back and forth in a linear fashion.

The unit 25 is especially designed for mounting at the drilling deck. However, it is also conceivable for such a unit to be used somewhere else where it would be practical to assemble or disassemble pipe stands.

The unit 25 can also function as intermediate storage for a pipe stand to be transported to and from a drilling centre. However, if the pipe stand protrudes from the drilling deck, it will not be possible to rotate the unit 25.

The invention claimed is:

1. A system for assembling and disassembling pipe stands, said system comprising:

a mousehole device arranged below a drilling deck, said mousehole device including at least two receiving chambers configured to be moved to and from at least one receiving and hand-over position; and at least one elevator arranged below the drilling deck to co-operate with the receiving chambers in order to move a pipe length longitudinally in the receiving chambers, wherein said at least one elevator is placed in connection with the at least one receiving and hand-over position so that said receiving chambers can be moved to engage the at least one elevator.

2. A system according to claim 1, further comprising:

a pipe rack;

a derrick is arranged on the drilling deck;

a carrying device configured to carry the pipe lengths between the pipe rack and the derrick; and a pipe handling unit, wherein when one of the at least two receiving chambers of the mousehole device is in said at least one receiving and hand-over position, the pipe handling unit is configured to hand over a pipe length to the receiving chamber or retrieve a pipe length from the receiving chamber.

3. A system according to claim 1, wherein the carrying device comprises a catwalk and a V-door lifter, the V-door lifter being configured to carry pipes between the catwalk and the mousehole device.

4. A system according to claim 1, wherein the drilling deck includes a opening, and the at least one receiving and hand-over position coincides with said opening in the drilling deck.

5. A system according to claim 1, wherein said at least one elevator comprises a hydraulic cylinder.

6. A system according to claim 1, wherein each receiving chamber is provided with a shock absorber made from a soft material, and the shock absorber is configured to receive a pipe landing thereon.

7. A system according to claim 1, wherein the receiving chambers are arranged on a rotatable unit.

8. A system according to claim 1, further comprising an roughneck arranged over the receiving chambers, said roughneck being arranged to screw a first pipe onto or unscrew it from a second pipe located in a receiving chamber.

9. A system according to claim 1, wherein said receiving chambers are arranged to co-operate with conveying devices for pipe stands, and conveying devices for single pipes, for conveyance into and out of the receiving chambers.

10. A system according to claim 1, wherein said at least one elevator comprises a chain sprocket wheels and a motor, and a sliding shoulder.

11. A system according to claim 1, wherein said mousehole device further comprises a foundation assembly fixed to the drilling deck, said foundation assembly including a turret, the at least one elevator is fixed to the foundation assembly, and the at least two receiving chambers is rotated with respect to the drilling deck by the turret so that each of the at least two receiving chambers is rotated to engage the at least one elevator by the rotation.

12. A system for assembling and disassembling pipe stands, said system comprising:

a mousehole device arranged below a drilling deck, said mousehole device including at least two receiving chambers configured to be moved to and from at least one receiving and hand-over position; and at least two elevators arranged below the drilling deck to co-operate with the receiving chambers in order to move a pipe length longitudinally in the receiving chambers, wherein each receiving chamber is associated with a respective elevator, and each elevator is configured to be moved together with the associated receiving chamber.

* * * * *